US005573814A

United States Patent [19]

Donovan

[11] Patent Number: 5,573,814

[45] Date of Patent: Nov. 12, 1996

[54] MASKING CYLINDER BORE EXTREMITIES FROM INTERNAL THERMAL SPRAYING

[75] Inventor: David A. Donovan, Chelsea, Mich.

[73] Assignee: Ford Motor Company, Dearborn, Mich.

[21] Appl. No.: 550,475

[22] Filed: Oct. 30, 1995

[51] Int. Cl.[6] ..... B05D 1/08; B05D 1/32

[52] U.S. Cl. ..... 427/448; 427/236; 427/239

[58] Field of Search ..... 427/448, 236, 427/239, 282; 118/504, 505

[56] References Cited

U.S. PATENT DOCUMENTS

| | | | |
|---|---|---|---|
| 4,178,397 | 12/1979 | Lovis | 427/300 |
| 4,264,647 | 4/1981 | Trevorrow | 427/238 |
| 4,743,462 | 5/1988 | Radzavich et al. | 427/300 |
| 5,270,085 | 12/1993 | Horiki et al. | 428/34.1 |
| 5,271,967 | 12/1993 | Kramev et al. | 427/456 |
| 5,358,753 | 10/1994 | Rao et al. | 427/456 |

*Primary Examiner*—Katherine Bareford
*Attorney, Agent, or Firm*—Joseph W. Malleck

[57] ABSTRACT

Method of masking one or more extremities of a cylinder bore from internal thermal spraying, when using a rotary gun inserted from one end of the bore, by essentially the steps of: (a) supporting one or more inflatable mask members adjacent an end of the bore wall; (b) pressurizing the inflatable mask member to expand and annularly engage an end of the bore, the mask being constituted of an inflatable and collapsible air tight bag of heat resistant (fiberglass) cloth coated on opposite sides with a sacrificial heat resistant non-stick coating (silicone). The inflatable characteristic of the mask member allows it to conform to the periphery of the cylinder bore extremities, and allows it to be easily installed in or through the component in its deflated condition. The mask is reusable by being comprised of coating material that may gradually be sacrificed to heat and wear of the over spray.

7 Claims, 2 Drawing Sheets

MASKING CYLINDER BORE EXTREMITIES FROM INTERNAL THERMAL SPRAYING

BACKGROUND OF THE INVENTION

1. Technical Field

This invention relates to the technology of preventing over spray of cavities of components and more particularly to masking complex components containing such cavities when carrying out thermal spraying within such cavities.

2. Discussion of the Prior Art

Thermal spraying of metal powder, droplets and other comminuted particles onto interior cylinder bore surfaces of an automotive engine block has become a significant, fabrication technique that forms a wear and anti-friction coating on such surfaces. Thermal spraying, whether by wire arc, plasma or flame, will project the particles in a relatively wide spray pattern at very high velocities from a gun nozzle that is stationed relatively close to the bore surface due to the restricted diameter of conventional cylinder bores (typically 4–6 inches). The combination of such high velocity and short travel distance will allow a small proportion of the particles to bounce or be deflected from the target surface resulting in over spray. Such over spray contaminates adjacent block surfaces not intended to be coated or such over spray merely fails free of the block as waste material. The adjacent surfaces may comprise the crankcase chamber and support surfaces for the crankshaft.

Early masking techniques used resilient or ablatable plugs to protect holes of components that are being thermally sprayed or painted. The plugs needed to be essentially the same size as the opening and needed to penetrate into the opening so that the resiliency of the plug obtained closure and conformance to the hole. Such plugs are not good for components having restricted access to the openings and are a detriment when the interior of the openings must not be penetrated or obscured to allow for proper spraying. Fixed templates of elastomor material have also been used to cover broad planar surfaces to be protected during spraying or painting. These templates are difficult to use when the component has a complex structure preventing easy access. Gases have also been used as a masking medium; gases are blown across the interior side of a folded or curled sheet material to mask such side from a molten bath of metal into which the folded sheet is dipped. If such technique were to be used with thermal spraying of internal cavities, such gases would interfere with the thermal spray deposition.

SUMMARY OF THE INVENTION

It is an object of this invention to provide a method of masking components to permit thermal spraying of cavities in such component, the masking enabling one or more of the following: (i) removable access of the spray-head into and out of the cavity while covering the cavity at one or more of its extremities; (ii) installation on components having complex structure surrounding the cavity extremities; (iii) traverse of the spray-head along the full length of the cavity; (iv) resistance to the high temperature of molten metal particles; and (v) transfers and collects waste over-spray particles.

The invention herein that meets such object comprises masking one or more extremities of a cylinder bore from internal thermal spraying, when using a rotary gun inserted from one end of the bore, by essentially the steps of: (a) supporting one or more inflatable mask members adjacent an end of the bore wall; (b) pressurizing the inflatable mask member to expand and annularly engage an end of the bore, the mask being constituted of an inflatable and collapsible air tight bag of heat resistant (fiberglass) cloth coated on opposite sides with a sacrificial heat resistant non-stick coating (silicone).

The inflatable characteristic of the mask member allows it to conform to the periphery of the cylinder bore extremities, and allows it to be easily installed in or through the component in its deflated condition. The mask is reusable by being comprised of coating material that may gradually be sacrificed to heat and wear of the over spray. In a more particular aspect of the invention, one set of inflatable mask members are saddled and ganged on a vacuum exhaust conduit that fits into the crankshaft spacing of the block allowing for ease of precise positioning of a plurality of collapsed mask members ready for inflation with the conduit ready for collection of over-spray. Another mask member may be saddled on the gun to ride therewith during cavity insertion to effect closure of the other extremity.

DETAILED DESCRIPTION IN BEST MODE

Figure 1:
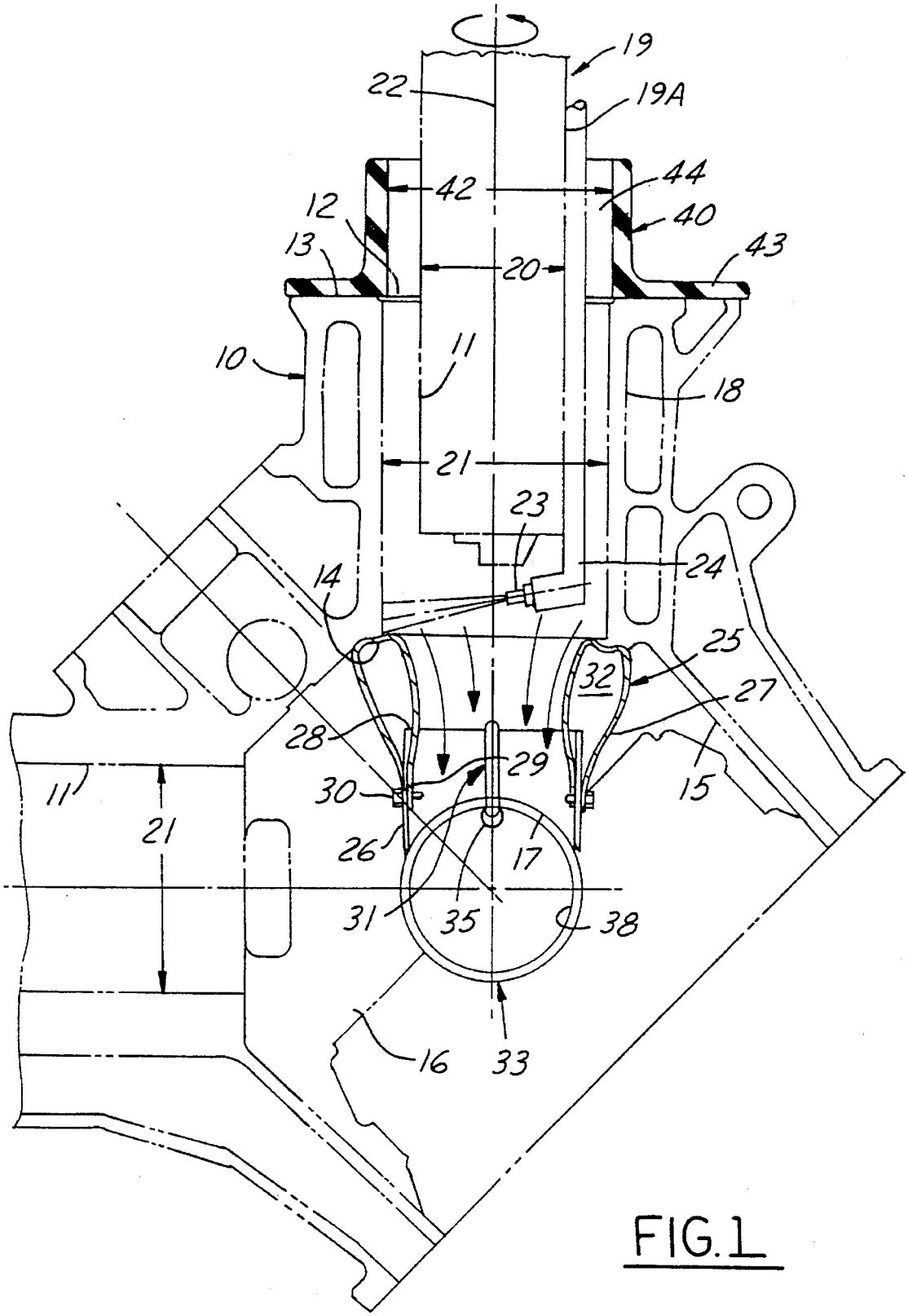
FIG. 1 is a sectional elevational view of an internal combustion engine block showing the mask members of this invention installed to prevent over spray while a row of rotary guns carry out thermal spraying of the interior of a bank cylinder bores.

As shown in FIG. 1, a v-shaped aluminum block 10, of an internal combustion engine, presents two rows or banks of cylinder bore cavities 11. One extremity or lip 12 of each bore cavity opens on to a flat deck 13 while the other extremity or lip 14 faces the crankcase chamber 15 of the block, such chamber being interrupted by several crankshaft bearing walls 16 that present semi-circular bearing surfaces 17. The block may also contain several other complex webs or walls, including walls 18 providing cooling passages about the cylinder bore cavities.

The thermal spray gun 19 is carried on a barrel 19A that has a diameter 20 smaller than the diameter 21 of the cylinder bore cavity. The barrel 19A rotates about an axis 22 coincident with the axis of the cylinder bore cavity. A spray nozzle 23 is directed radially across the axis of the bore and is fed with primary and/or secondary gases from a gas supply line 24.

Figure 3:
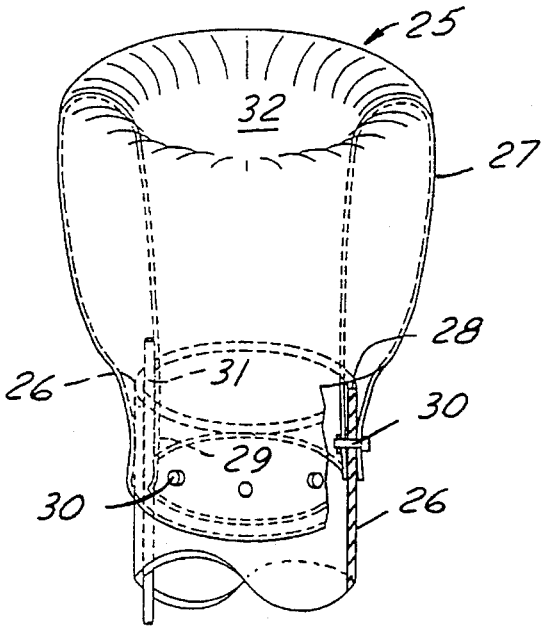
FIG. 3 is an enlarged prospective view of one doughnut shaped inflated mask member.

The lower end or extremity 14 of the cylinder bore cavity is masked by use of an annular inflatable mask member 25. Such member, as shown in FIG. 3, is comprised of a rigid cylindrical collar base 26, usually of temperature lo resistant sheet metal, and a bag 27 of cloth that is folded over or looped over and along the upper rim 28 of the collar base 26. The edges or cuffs 29 of the cloth bag are secured to opposite sides of the collar base by fasteners 30 to effect an air tight seal and create a doughnut shaped form when inflated to engage the annular extremity of the bore wall. The inflated bag is hollow in its center to allow excess thermal spray to pass and be evacuated therethrough. Am air supply nozzle 31 is secured along the interior of the collar base to extend into the bag interior 32 along folded cuff of cloth. The cloth is comprised of fiberglass or other heat resistant cloth and is coated on both sides with a heat resistant non-sticking material, such as silicone in a thickness of about 0.04 inches. The silicone coating on the exterior will gradually wear away by erosion or burning from contact with splatter; such sacrificial coating allows the inner coating to remain viable and promote air tightness of the bag.

Figure 2:
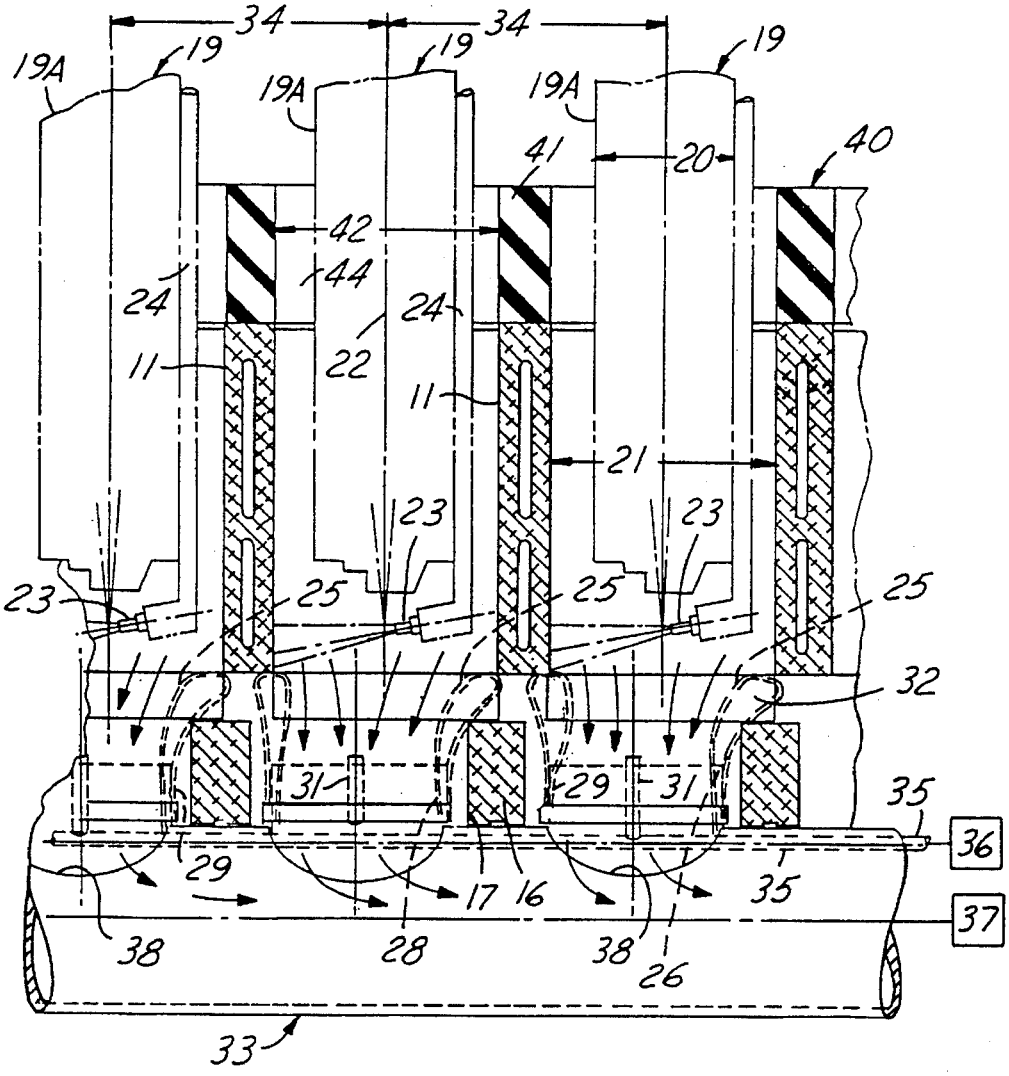
FIG. 2 is a sectional view taking substantially a long line 2—2 of FIG. 1.

The plurality of collar bases 26 are supported on an elongated exhaust vacuum manifold tube 33, as shown in FIG. 2. The collar bases are placed at intervals 34 equal to the spacing of the cylinder bore cavities along the bank of the block. An air supply line 35 extends along the manifold tube 33 and communicates with each of the nozzles 31 for selective inflation of each mask member 25. A suitable air supply 36 is provided for line 35 and a suitable vacuum source 37 is provided for the manifold tube 33. A cut-out opening 38 is made in the manifold tube for each collar base, conforming to the footprint of each collar base as it intersects with the manifold tube.

The upper end or extremity 13 of the cylinder bore cavity is masked by a flanged sleeve 40 surrounding the gun 19. The flanged sleeve is comprised of a sleeve portion 41 having an internal diameter 42 greater than the diameter 20 of the barrel 19A of the gun and comprised of a flat flanged portion 43 adapted to fit flush against the deck 13 of the block. The spacing 44 allows air to be admitted to the cavity for facilitating an exhaust stream induced by the vacuum manifold tube to withdraw over spray particles. The flanged sleeve 40 is slideably supported on the gun barrel 19A so that upon insertion of the gun to the mouth of the cavity, the flanged sleeve will close off the upper extremity of the cavity except for limited air admission and thereby protect the block face from contamination. As the gun penetrates deep into the bore cavity, the flanged sleeve remains in flush contact with block deck while the gun slides there through. Alternatively, the flanged sleeve may be constituted as an inflatable member if needed.

The method of this invention thus uses inflatable shapes conforming to the periphery of the cylinder bore wall extremities; the inflatable shapes are carried on an exhaust manifold tube for ease of insertion and accuracy of positioning; the inflatable shapes are coated so as to have a surface that is partial sacrificial for reusability; and the upper bore wall extremities closed by fixed or inflatable shape that is saddled on the spray gun. The mask member is resusable for repetitive thermal spraying cycles, the coating exposed to over spray of said spraying partially ablating or partially eroding away with repeated use.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

I claim:

1. A method of masking cylinder bore extremities from internal thermal spraying by use of a rotary gun inserted from one end of the bore, the method comprising the steps of:

(a) supporting one or more inflatable mask members adjacent an end of the bore wall; and (b) pressurizing the inflatable mask member to expand and annularly engage such end of the bore wall, said mask member being constituted of an inflatable and collapsible air tight bag of heat resistant cloth coated on opposite sides with a sacrificial heat resistant non-stick coating.

2. The method as in claim 1, in which said mask member when inflated is doughnut shaped effective to resiliently and sealingly engage the annular end of the bore wall.

3. The method as in claim 1, in which said cloth is comprised of fiberglass and said coating is comprised of silicone effective to make the cloth air tight.

4. The method as in claim 1, in which said cylinder bore wall is part of an engine block and said mask members are supported on an elongated exhaust manifold tube extending through the block in the space normally occupied by a crank shaft, said manifold tube having opening in communication with bores through an interior of said doughnut shaped masked members.

5. The method as in claim 1, in which said mask member is reusable for repetitive thermal spraying cycles, the coating exposed to over spray of said spraying partially ablating or partially eroding away with repeated use.

6. The method as in claim 1 which comprises (c) supporting an annular flanged mask member on the gun that is inserted into the cylinder bore wall, said flanged mask member being slideable longitudinally along the gun to assure and retain closure with said one end where the gun is inserted after the gun continues to move longitudinally within the bore wall.

7. The method as in claim 6, in which said flanged mask member has a flange that is inflatable.

* * * * *